US005947674A

United States Patent [19]

Malsbury et al.

[11] Patent Number: 5,947,674

[45] **Date of Patent: *Sep. 7, 1999**

[54] COKING VESSEL UNHEADING DEVICE AND SUPPORT STRUCTURE

[75] Inventors: Allen Slocum Malsbury, Parsippany, N.J.; Ronald Theodore Myszka, Bethlehem; Joseph Anthony Kalinosky, Allentown, both of Pa.

[73] Assignee: Foster Wheeler USA Corp., Clinton, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/683,844

[22] Filed: Jul. 19, 1996

[51] Int. Cl.[6] ..... C10B 33/00

[52] U.S. Cl. ..... 414/216; 202/241; 202/252; 414/589

[58] Field of Search ..... 414/216, 292, 414/589, 609; 202/241, 244, 251, 252

[56] References Cited

U.S. PATENT DOCUMENTS

| | | | |
|---|---|---|---|
| 2,580,700 | 1/1952 | Phillips | 202/252 X |
| 4,726,109 | 2/1988 | Malsbury et al. | 202/241 X |
| 4,960,358 | 10/1990 | DiGiacomo et al. | 202/241 X |
| 5,098,524 | 3/1992 | Antalfy et al. | 202/252 X |
| 5,336,375 | 8/1994 | Wallskog et al. | 202/252 X |
| 5,500,094 | 3/1996 | Fruchtbaum et al. | 414/216 X |
| 5,581,864 | 12/1996 | Rabet | 202/252 X |
| 5,628,603 | 5/1997 | Antalffy et al. | 414/216 |

*Primary Examiner*—David A. Bucci
*Attorney, Agent, or Firm*—Martin Smolowitz

[57] ABSTRACT

An unheading device for removable attachment onto a lower flanged opening of a vertically-oriented vessel such as a coking drum, the unheading device being controllably supported by multiple elongated vertically-extendable actuators such as hydraulic cylinders which extend between a lifting frame unit holding a head unit and the vessel support structure. The multiple vertically-extendable actuators are each pivotably attached at its lower end to the lifting frame unit, and are each pivotably attached at its upper end to the separate stationary support structure for the vessel. The unheading device is adapted for lowering the head unit and moving it laterally aside to a parking position on a platform portion of the vessel support structure, then raising the lifting frame unit with its attached decoking chute unit to contact the vessel lower flanged opening for coke removal therefrom. After such coke removal step, the decoking chute can be lowered and the head unit returned laterally to a position below the vessel, and then lifted by the multiple actuators and reconnected onto the vessel lower flange.

10 Claims, 6 Drawing Sheets

COKING VESSEL UNHEADING DEVICE AND SUPPORT STRUCTURE

BACKGROUND OF INVENTION

This invention pertains to a vertical vessel unheading device and its associated support structure. It pertains particularly to such an unheading device for the lower flange and head assembly of a coking vessel, which device is movably supported directly from the vessel support structure by multiple elongated extendable actuators each pivotably attached to such support structure and the device is arranged for periodic removal and replacement during vessel operations.

Unheading devices provided at the lower end of large coking drums or vessels used in petroleum refinery operations and which are capable of remote operation are known, such as disclosed by U.S. Pat. No. 4,726,109 to Malsbury et al and U.S. Pat. No. 4,960,358 to DiGiacomo et al. In past installations of such remotely operated unheading devices for coking vessels, the unheading device has been supported by four vertically oriented actuator cylinders pivotably attached to trunnions welded onto the coking vessel bottom cone section. However, these welded attachments require regularly scheduled inspection and testing to ensure desired load capacity of the attachment welds. Because any needed repairs could require undesired post weld heat treatment locally at the attachment welds and extending undesired vessel shutdowns, an improved unheader device support arrangement for such vertically-oriented actuator cylinders for such unheading devices is needed.

SUMMARY OF INVENTION

This invention provides an improved unheading device and associated support structure for a vertical vessel, and includes a head unit which is removably attachable to a lower flanged opening of the vertical vessel such as a coking vessel. The head unit is supported by multiple generally vertically-oriented actuators which extend between a lifting frame unit of the unheading device and the vessel separate support structure. With this arrangement, the loads applied by the unheading device multiple actuators to the lifting frame while supporting the head unit are transferred directly to the vessel separate support structure, rather than being undesirably carried by and transferred through the vessel bottom conical section to the vessel support structure. The loads are carried by the multiple actuators when the coking vessel bottom head unit is being held securely in place during the head unit detachment and reattachment steps. The multiple actuators exert an upward force capable of supporting an entire column of coke and water in the coking vessel, which force is transferred directly to the vessel separate support structure, which also includes a horizontal platform member useful for supporting the head unit when in a lateral or offset parking position.

Accordingly, the unheading device and support structure according to this invention includes a head unit adapted for removable attachment to a lower flanged opening of a vertical vessel; clamping means for fastening and unfastening the head unit to the lower flanged opening so as to permit downward removal of the head unit from the vessel, a vertically movable lifting frame adapted for supporting and lowering the head unit from the vessel lower flange, the lifting frame unit having an extendable decoking chute attached to its lower side; multiple actuators extending substantially vertically between the lifting frame and an external support structure for the vessel, and a cover cradle/skid unit including dual horizontal actuators adapted for moving the head unit laterally to a side parking position on the horizontal stationary platform and return.

The improved unheading device of this invention is arranged to be supported directly from a coking vessel separate support structure, and provides for the head unit to be unfastened and lowered by the lifting frame unit from the coking vessel lower flanged opening, and for lateral movement of the head unit by the cover/cradle skid unit to a side position on a platform support member, while the extendable decoking chute is raised to connect with the vessel lower flanged opening for coke removal therefrom, and for subsequent return movement and reattachment of the head unit onto the vessel lower flange. More specifically, after the head unit cover plate is unfastened from the vessel lower flanged opening, the lifting frame lowers the head unit by operation of the multiple vertically-oriented actuators which are each pivotably attached at its upper end to the vessel separate support structure, and the cover/cradle skid unit moves the head unit laterally from beneath the coking vessel to a side parking location on an auxiliary platform by means of dual horizontal actuators. Because the lifting frame unit also includes the cylindrical-shaped decoking chute attached to the lower side of the lifting frame unit, the chute can be raised by the lifting frame unit upwardly to contact the coking vessel lower flanged opening after the head unit has been carried by the cover/cradle skid unit to its side position. The cover/cradle skid unit lateral movement permits the decoking chute to be raised by the lifting frame unit into contact with the vessel lower flanged opening such as for a vessel decoking step. The decoking chute is equipped with an upper end seal ring provided at the lower flanged opening of the coking vessel, and also has an annular lower seal ring provided between the chute and the stationary platform. When the decoking chute is in its fully raised position, the two seals prevent backflow and escape of vapors (steam) and hot water during the coke cutting operation in the vessel.

After a decoking operation for the coking vessel has been completed, the unheading device is adapted so as to lower the lifting frame unit and the decoking chute, and for the head unit to be returned laterally from its side position by the dual horizontal actuators so as to be repositioned on the lifting frame unit in accurate vertical alignment with the vessel lower flange. Then the head unit is lifted up by the lifting frame unit into accurate engagement with the vessel lower flange by the multiple substantially vertical actuators of the lifting frame unit. To ensure accurate engagement and installation of the head unit fastener bolts, the head unit is provided with two alignment pins which are circumferentially oriented 180° apart and each fit into a tapered hole in the vessel lower flange. The head unit fastener bolts are then refastened pressure-tightly into place. The multiple vertical actuator mechanisms for the lifting frame unit and decoking chute is preferably provided by four equally-spaced hydraulic cylinders each pivotably attached at its lower end to the rectangular lifting frame unit at its four outer corners and each pivotably attached at its upper end to the separate support structure for the vessel. The multiple actuators are operated by suitable remote control means such as a hydraulic fluid pressure source.

An advantage of this invention is that a lower head cover unit for a vertically-oriented vessel such as a coking vessel can be conveniently removed from the vessel by utilizing the remotely operated unheading device, which lowers the head unit and moves it laterally aside, after which it raises a decoking chute and seals it to the vessel lower flange and also to the stationary platform of the coking vessel structure, with all units being supported directly and reliably from the coking vessel separate support structure. Such an unheading device permits periodic rapid and reliable removal of coke deposited in the coking vessel, so as to increase the available on stream operating time for the vessel, and also improves personal safety by avoiding undesirable exposure of personnel to hot hydrocarbons, steam and water during such unheading operations. This unheading device can be advantageously used for either new or existing delayed coking vessel for decoking the vessel at desired intervals rapidly and safely.

BRIEF DESCRIPTION OF DRAWINGS

This invention will be further described with reference to the following drawings, in which.

DESCRIPTION OF INVENTION

Figure 1:
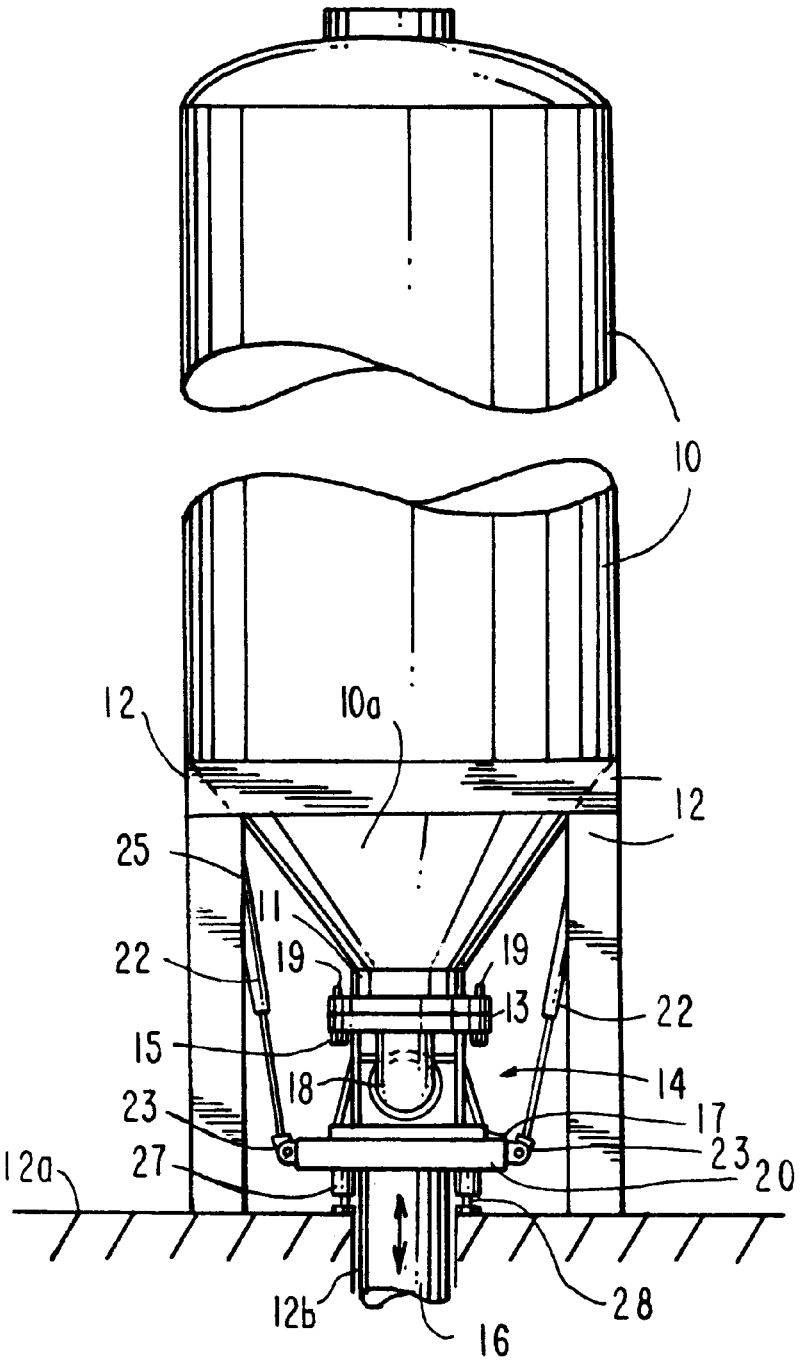
FIG. 1 shows an elevation view of a vertically-oriented vessel which has a unheading device and platform support means provided at the vessel lower end, the unheading device being supported by multiple actuators extending substantially vertically between the unheading device and the vessel separate support structure.

As generally shown by FIG. 1, a vertically-oriented coking vessel 10 is supported by a suitable support structure 12 provided beneath the vessel 10, the structure including a horizontal stationary platform portion 12*a* all constructed of reinforced concrete or steel. Such coking vessels 10 as used in petroleum refinery operations are usually 20–28 ft. diameter by 75–100 ft. tall, and have a lower conical shaped portion 10*a* and a nozzle opening 11 connected to a lower flange 13, which is usually 5–6 ft. diameter. As shown by FIGS. 2–5, a removable lower head unit 14 includes an upper cover plate 14*a* which is attached pressure-tightly to the vessel flange 13 by a plurality of suitable fastener means 15 such as bolts or similar means. Coke deposited in the coking vessel 10 during its extended operations in a petroleum refinery is removed from the vessel periodically as needed by removing the lower head unit 14 and cutting the coke from within the vessel. The loosened coke falls through the nozzle opening 11 and flange 13 and then through a decoking chute 16 into a storage pit or rail car (not shown) for removal, the decoking chute 16 being removably connectable to the flange 13.

Figure 2:
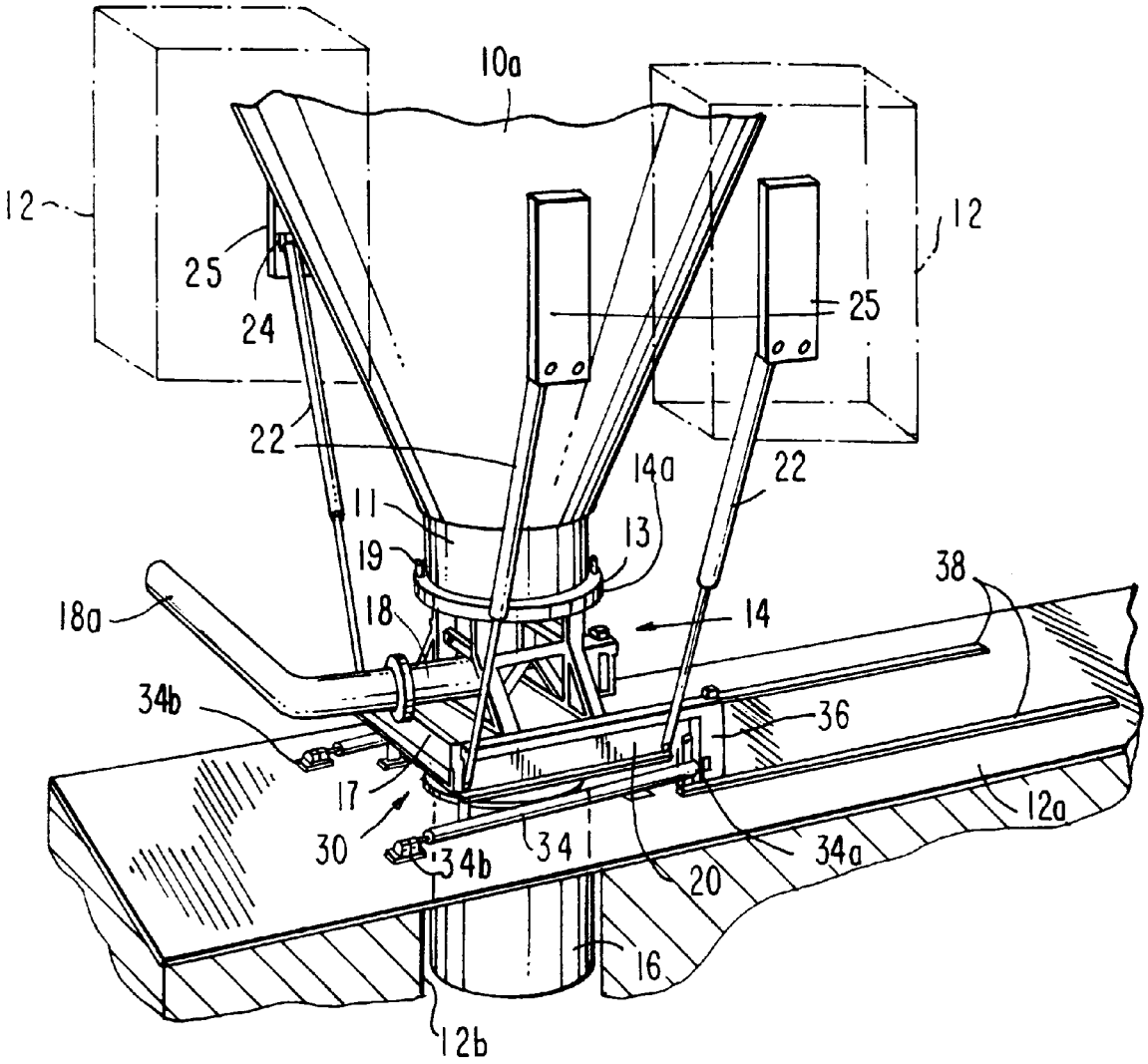
FIG. 2 shows an enlarged perspective view of the vessel unheading device including a head unit attached pressure-tightly to the lower flange of the vertical vessel, a lifting frame unit including multiple vertically-oriented actuators pivotably attached to the vessel separate support structure, and a cover/cradle skid unit for moving the head unit laterally aside.
Figure 3:
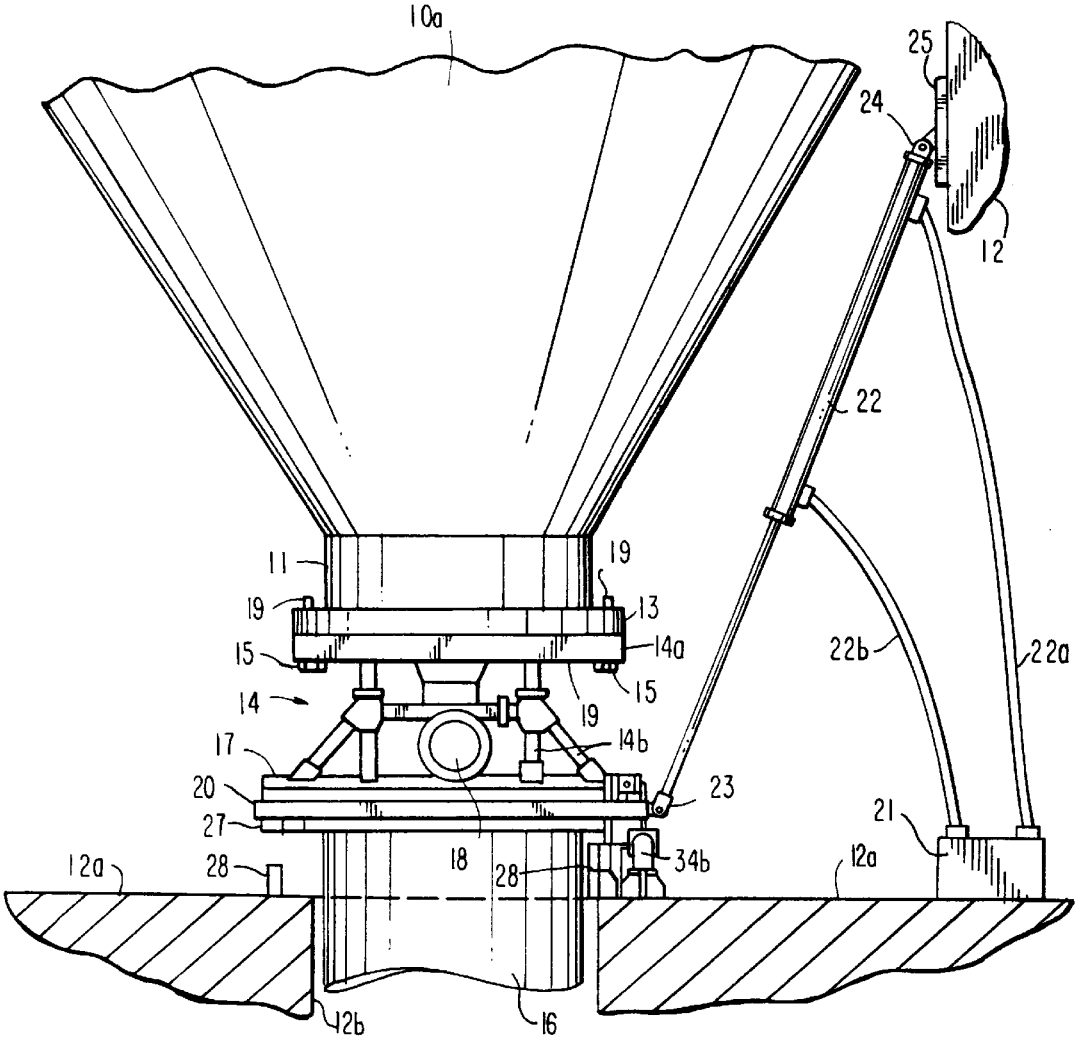
FIG. 3 shows an enlarged elevation view of the attachment means for one of the vertically-oriented actuators onto both the lifting frame unit and the vessel separate support structure.

As additionally shown by FIGS. 2 and 3, the head unit 14 is attached rigidly by suitable structural members 14*b* onto a lower cover/cradle skid 17. Head unit 14 also includes a feed pipe stub 18 which is flow connected to upper cover plate 14*a* and extends laterally therefrom for use in feeding fluids such as hydrocarbon liquid, steam and water from pipe 18*a* into the coking vessel 10, and for draining fluids from it as needed.

The head unit 14 and its lower cover/cradle skid 17 are supported by a lifting frame unit 20, which is vertically movable. The lifting frame unit 20 is supported from the vessel main stationary support structure 12 by four elongated vertically-oriented actuators 22. These four actuators are preferably hydraulic pressure actuator cylinders 22 are equally spaced apart, and are each oriented at an angle of 15–45° relative to the vertical centerline of vessel 10 and head unit 14. Each actuator cylinder 22 is pivotably attached at its lower end 23 onto the lifting frame unit 20 at its four corners. The four actuator cylinders 22 are also each pivotably attached at its upper end 24 to a separate suitable bracket or embedment plate 25, which is rigidly secured to a vertical member of the vessel support structure 12, as shown in greater detail in FIGS. 2 and 3. Locations for the upper end pivotable attachments 24 for the four actuator cylinders 22 is determined by the geometry of the lifting frame unit 20 and the decoking chute 16, and the attachments 24 are usually on the flat vertical face of an opening 12*b* in the support structure 12 through which the vessel conical-shaped portion 10*a* extends downwardly. Such attachment location at 24, 25 onto the separate support structure 12 minimizes undesired heat transfer from the hot coking vessel 10 to the hydraulic actuator cylinders 22. Alternatively, for incorporating the unheading device into existing coking vessels, suitable auxiliary structural members (not shown) can be provided and the embedment plates 25 can be incorporated to the vessel separate support structure 12 at appropriate locations on the auxiliary members.

The four hydraulic actuator cylinders 22 include suitable flexible hoses 22*a* and 22*b*, and a hydraulic pressure control means 21 which provide for the actuator cylinders to be extended equally and evenly, so that the lifting frame unit 20 supporting the head unit 14 is lowered and lifted evenly without any undesired tipping movements. As shown by FIGS. 1–4, two alignment pins 19 equally-spaced apart are provided attached rigidly onto the head unit 14 upper cover 14*a* to assure accurate alignment of head unit 14 with the vessel lower flange 13 whenever the head unit is raised to contact the lower flange 13. The fastener means 15 for head unit 14 onto the vessel lower flange 13 are individual bolts and nuts. The lifting frame 20 is provided with four guide tubes 27 located at the corners of the frame and which mate with four alignment pins 28 attached rigidly to the horizontal platform 12*a*, so as to assure accurate vertical alignment of the lifting frame unit 20 when it is lowered by actuator cylinders 22 onto the platform 12*a*. The lifting frame 20 is supported in its lowered position by the guide tubes 27 which are attached to and extend downward from the lifting frame 20 onto the alignment pins 28.

Figure 4:
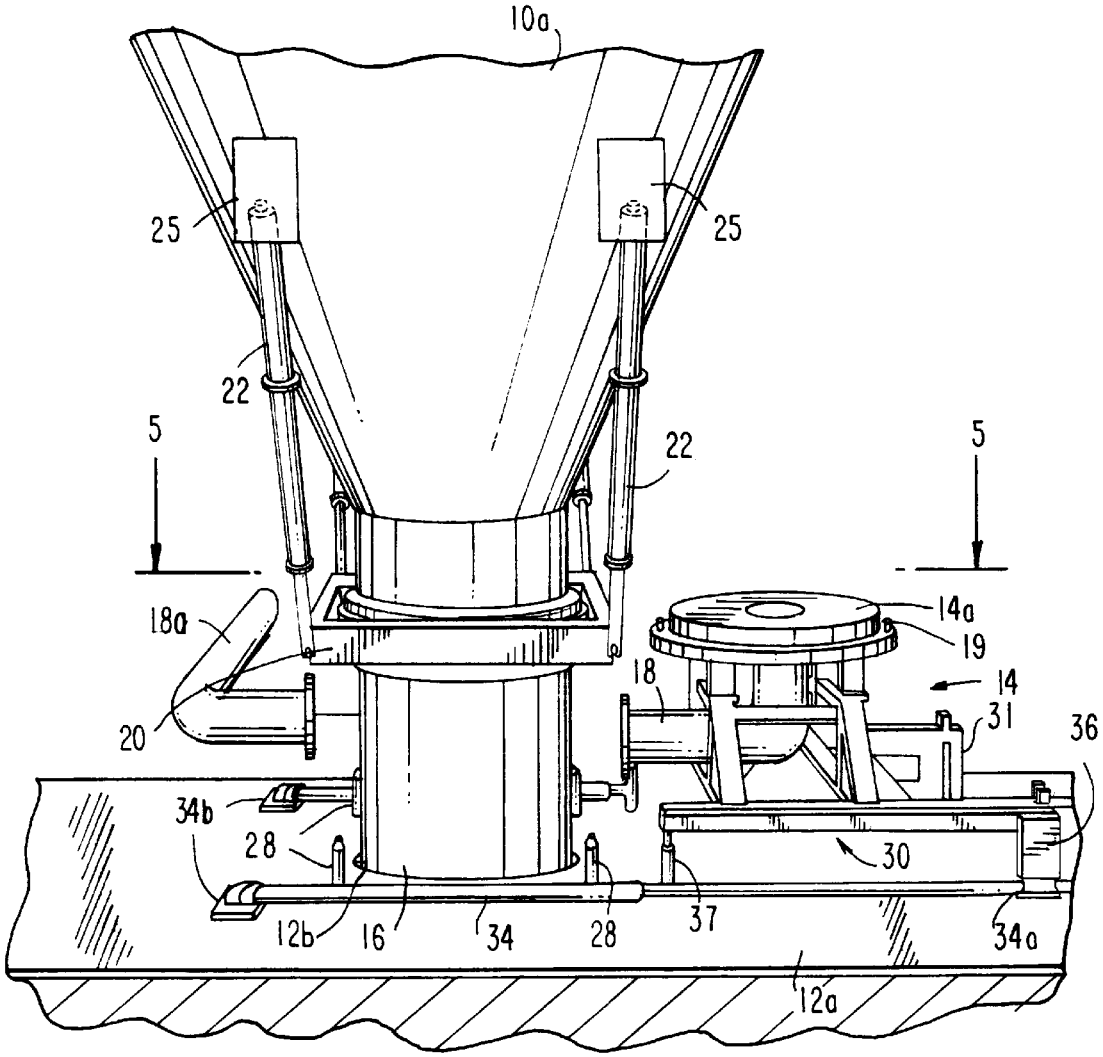
FIG. 4 shows a perspective view similar to FIG. 2 but with the head unit being detached from the vessel lower flange and moved laterally aside by the cover/cradle skid unit to a parking position on a platform portion of the vessel support structure, and a decoking chute raised to contact and seal with the vessel lower flange.
Figure 5:
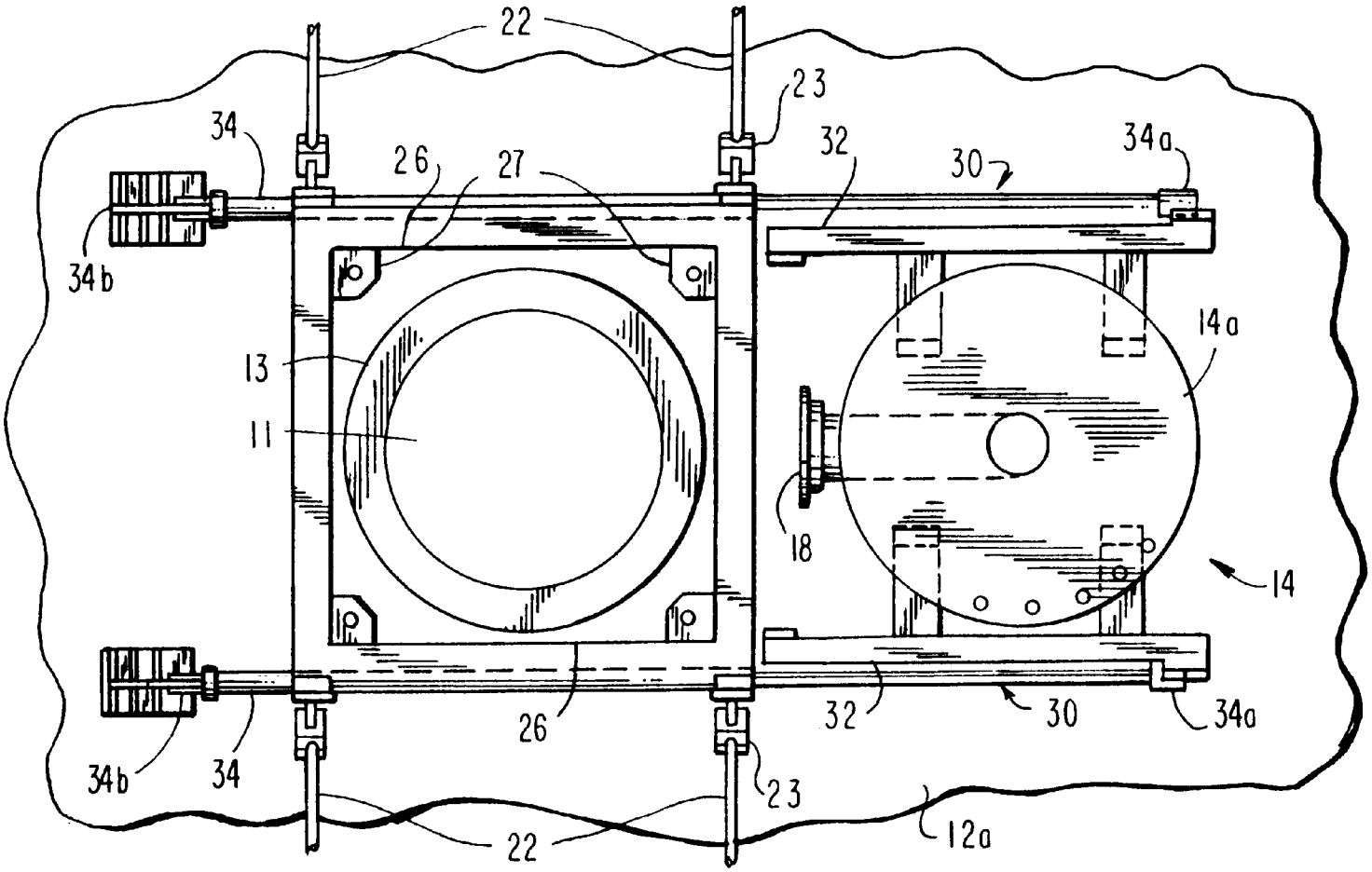
FIG. 5 shows a plan view of the unheading device taken at sectional line 5—5 of FIG. 4.

As also shown in FIGS. 2, 4 and 5, a cover/cradle unit 30 having dual parallel guide surfaces 32 is interfitted within a central portion of the lifting frame unit 20. Dual horizontal extendable actuators 34 are each pivotally attached at its forward end 34*a* to one side of the cover/cradle skid unit 30, and are each pivotally attached at its rearward end 34*b* onto the horizontal platform portion 12*a* of the vessel support structure 12. These dual actuator attachments to the cover/cradle skid unit 30 provide for the head unit 14 to be moved laterally to a side parking position on the platform 12*a* by the dual actuators 34, as shown by FIGS. 4 and 5. During the lateral movement of the cover/cradle skid unit 30 to its side position on platform structure 12*a*, it is supported on the platform structure at its forward end 31 by dual moveable brackets 36 which are guided along dual tracks 38 provided in the platform structure 12*a*. The cover/cradle skid unit 17 is supported at its rearward end by dual support chairs 37 which are attached to and extended upwardly from the platform 12*a*.

Figure 6:
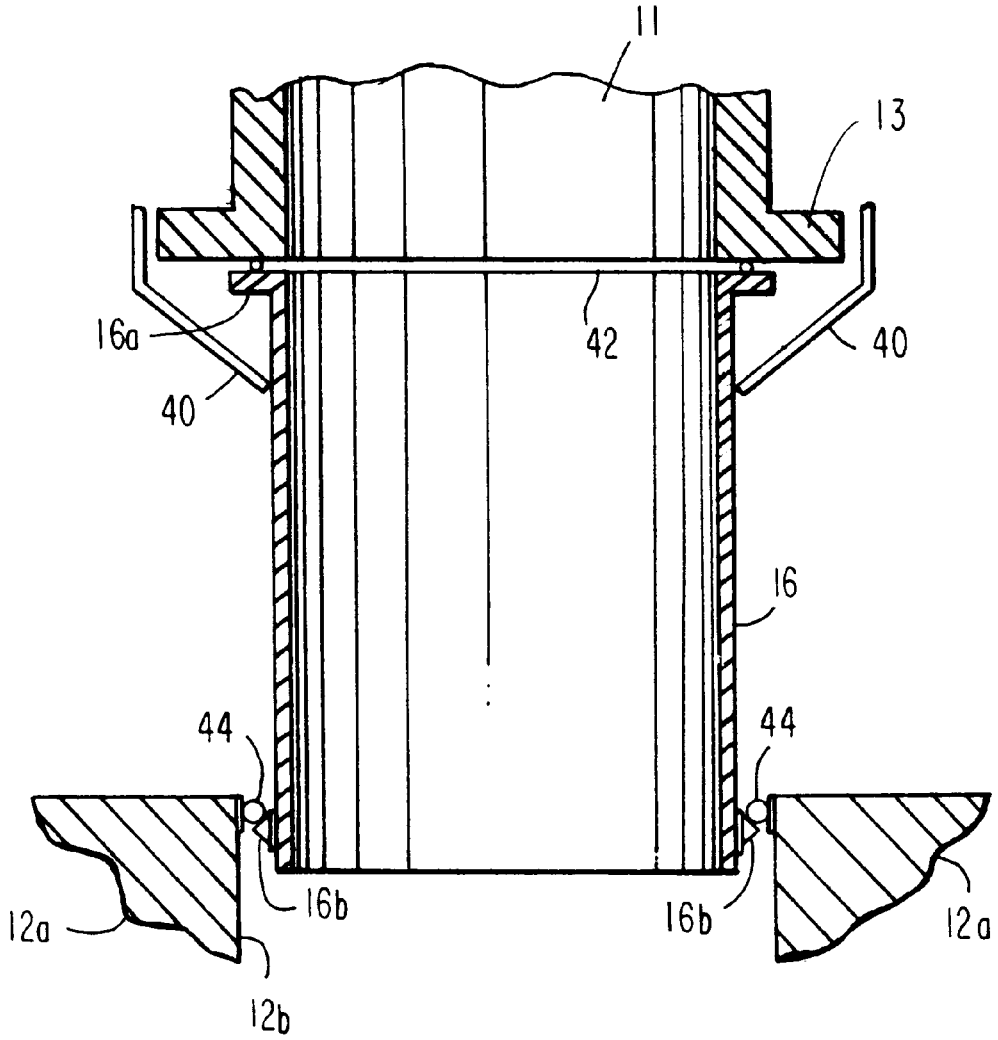
FIG. 6 shows an elevation view of the decoking chute which includes a gasket seal means at its upper end for sealing the chute against the vessel lower flange, and an annular seal means at its lower end for sealing the chute to the support structure platform.

After the cover/cradle skid unit 30 and head unit 14 have been moved aside onto the platform 12*a*, the lifting frame unit 20 which has the decoking chute 16 attached onto its lower side, is moved upwardly by action of the four vertical actuators 22, so that the upper end of the decoking chute 16 is held firmly and sealed against the lower flanged opening 13 of the coking vessel 10. As shown by FIG. 6, the coking chute 16 extends through a circular opening 12*b* in the platform 12*a*. The upper end of the decoking chute 16 includes an annular outer sleeve portion 40 which extends upwardly adjacent to the outer periphery of the lower flange 13 of vessel 10, so as to provide a guide means for vertical alignment of the decoking chute 16 with the flange. A sealing ring 42 is provided between the upper flange 16*a* of the chute 16 and the vessel lower flange 13. The lower end of decoking chute 16 is also sealed to the opening 12*b* in platform 12*a* by a flexible sealing ring 44 which is positioned between an annular projection 16*b* of the chute 16 and the inner surface of circular opening 12*b* in the platform structure 12. The sleeve sealing ring means 40 and seal rings, 42 and 44 serve to effectively prevent the undesirable escape of steam and hot water from the vessel flange 13 and chute 16. The coke accumulated within the vessel 10 is removed through the chute 16 to a storage pit or rail car (not shown) for further handling and use, as generally shown by FIGS. 2 and 4.

After removal of coke from the coking vessel 10 has been completed, the lifting frame unit 20 carrying the attached decoking chute 16 is lowered by the four generally vertically-oriented actuators 22 to its lower position onto the platform 12*a*. Next, the dual horizontal actuators 34 move the cover/cradle skid unit 17 back to its original position so as it interfits with the dual guide surfaces 26 of the lifting frame unit 20. Then the lifting frame unit 20 is lifted upwardly by the four vertical actuators 22, and head unit 14 is vertically guided by the dual alignment pins 19 and returned to its original position with the head unit 14 aligned with the vessel lower flanged opening 13. Next, the fastener bolts 15 are replaced to attach the head unit 14 pressure-tightly onto the flange 13, as shown by FIGS. 1–3.

Although this invention has been disclosed broadly and as a preferred embodiment, it will be understood that modifications and variations can be made within the scope of the invention as defined by the claims.

We claim:

1. An unheading device for a vertical vessel and adapted for being removably supported from a separate support structure for the vessel and removably attached onto a lower flanged opening of the vessel, the device comprising:

(a) a head unit including a head cover plate fixedly attached onto a cover/cradle skid, said head cover plate being adapted for removable attachment onto a lower flanged opening of the vertical vessel;

(b) a lifting frame unit adapted for supporting the cover/cradle skid of said head unit and for vertically moving the head unit, said lifting frame unit including a vertically extendible chute unit attached to the lifting frame unit lower side;

(c) multiple elongated generally vertically oriented extendible actuator means each actuator being pivotally attached at its lower end to a corner of said lifting frame unit, each said extendible actuator means being pivotally attached at its upper end to a separate stationary support structure for the vessel; and (d) a cover/cradle skid unit including dual horizontal actuators adapted for moving said head unit from the lifting frame unit laterally to a side parking location on a stationary platform portion of the vessel separate support structure relative to said vessel lower flanged opening, whereby the head unit and its lifting frame unit can be controllably lowered by the multiple vertical-extendible actuators which are each pivotably attached at its upper end to the vessel separate support structure and moved aside by the dual horizontal actuators for the cover/cradle skid unit so as to permit removing accumulated material through the lower flanged opening of the vertical vessel and the extendible chute unit, after which the head unit can be returned laterally, lifted and the cover plate reattached pressure-tightly to the vessel lower flanged opening.

2. The unheading device according to claim 1, wherein said head unit upper cover plate is attached pressure-tightly onto the lower flanged opening of a vertical coking vessel.

3. The unheading device according to claim 1, wherein each said multiple vertically-extendable actuator is oriented at an angle of 15–45° with the vertical centerline of said head unit and the vessel.

4. The unheading device according to claim 1, wherein said multiple elongated vertically-extendable actuators consists of four hydraulic-actuated cylinders, each cylinder having its upper end pivotably attached to an embedment plate which is rigidly attached to the separate stationary support structure for the vessel.

5. The unheading device according to claim 1, wherein said head unit includes vertical alignment means for aligning the head unit cover plate with the lower flanged opening of the vessel during lifting of the head unit by the lifting frame unit.

6. The unheading device according to claim 1, wherein said stationary platform portion is rigidly attached to the separate stationary support structure for the vessel.

7. The unheading device according to claim 4, wherein said multiple vertically-extendible actuators include hydraulic pressure control means adapted for assuring uniform vertical movement of the actuators and said head unit.

8. The unheading device according to claim 1, wherein said vertically extendible chute unit includes seal means for sealing the chute upper end to the lower side of the vessel flanged opening.

9. The unheading device according to claim 1, wherein said vertically extendible chute unit includes an annular seal ring means for sealing the chute outer surface to an opening in the support structure stationary platform.

10. An unheading device for a vertical vessel and adapted for being removably supported from a vessel separate support structure and removably attached onto a lower flanged opening of the vessel, the device comprising:

(a) head unit including an upper head cover plate, said head unit being fixedly attached onto a cover/cradle skid, said head cover plate being adapted for removable attachment onto a lower flanged opening of the vertical vessel;

(b) a lifting frame unit adapted for contacting the cover/cradle skid of said head unit and for supporting and vertically moving the head unit, said lifting frame unit including a vertically extendible chute unit attached to said lifting frame unit lower side;

(c) four equally-spaced generally vertically extendible hydraulic-operated actuator cylinders, each said actuator cylinder being pivotably attached at its lower end to a corner of said lifting frame unit, and each said actuator cylinder being pivotably attached at its upper end to an embedment plate of a separate stationary support structure for the vessel, said actuator cylinders each being aligned at an angle of 15–45° with the vertical centerline of the vessel; and (d) a cover/cradle skid unit including dual horizontal actuators adapted for moving said head unit from the lifting frame unit laterally to a side parking location on a stationary platform portion of said vessel separate support structure relative to said vessel lower flanged opening, whereby the head unit and its lifting frame unit can be controllably raised and lowered by the four vertical extendible hydraulic actuator cylinders, and moved aside by the dual horizontal actuators for the cover/cradle skid unit so as to permit removal of accumulated material through the lower flanged opening of the vertical vessel and the extendible chute unit, after which the head unit can be laterally return to below the vessel lower flanged opening, then lifted and the cover plate reattached to the vessel lower flanged opening.

* * * * *